United States Patent [19]

Jencks

[11] Patent Number: 4,977,759

[45] Date of Patent: Dec. 18, 1990

[54] CIRCULAR WARP KNITTING MACHINE

[75] Inventor: Davis C. Jencks, Seekonk, Mass.

[73] Assignee: New England Overseas Corporation, Inc., Providence, R.I.

[21] Appl. No.: 360,102

[22] Filed: Jun. 1, 1989

Related U.S. Application Data

[63] Continuation-in-part of Ser. No. 182,497, Apr. 18, 1988, Pat. No. 4,838,043.

[51] Int. Cl.[5] ..... D04B 25/02

[52] U.S. Cl. ..... 66/81; 66/125 R

[58] Field of Search ..... 66/8, 9 A, 81, 125 R, 66/207

[56] References Cited

U.S. PATENT DOCUMENTS

| | | | |
|---|---|---|---|
| 1,237,106 | 8/1917 | Scott et al. | 66/8 |
| 3,570,268 | 3/1971 | Nogues | 66/81 |
| 3,939,671 | 2/1976 | Lawson et al. | 66/86 R |
| 4,192,160 | 3/1980 | Duhl et al. | 66/207 |

FOREIGN PATENT DOCUMENTS

| | | | |
|---|---|---|---|
| 2926773 | 1/1980 | Fed. Rep. of Germany | 66/125 R |
| 500189 | 11/1954 | Italy | 66/8 |
| 23650 | of 1903 | United Kingdom | 66/8 |

*Primary Examiner*—Wm. Carter Reynolds

*Attorney, Agent, or Firm*—Bell, Seltzer, Park & Gibson

[57] ABSTRACT

Improved drive means is provided for imparting clockwise and counterclockwise reciprocal movements to the yarn guides of a circular warp knitting machine including a plurality of vertically reciprocated needles. The improved drive means includes an endless timing belt drivingly connected to the yarn guides and a crank arm drivingly connected at one end to the endless timing belt. A rotary drive wheel is connected to the opposite end of the crank arm for imparting continuous longitudinal reciprocation to the crank arm and to thereby impart reciprocating movement to the endless timing belt and the yarn guide drivingly connected thereto. The yarn guide may include a first yarn guide for directing a base or ground yarn to the needles and a second yarn guide for directing an inlay yarn to the needles. Endless timing belts are utilized in driving each of the base yarn guide and the inlay yarn guide and the timing belt drive permits the circular warp knitting machine to be operated at an increased operating speed.

5 Claims, 2 Drawing Sheets

CIRCULAR WARP KNITTING MACHINE

REFERENCE TO RELATED APPLICATION

This is a continuation-in-part of my copending application Ser. No. 07/182,497, filed Apr. 18, 1988, now U.S. Pat. No. 4,838,043.

FIELD OF THE INVENTION

This invention relates generally to a circular warp knitting machine of the type usually utilized in knitting a composite cord or yarn in circular warp knit tubular form, and more particularly to a circular warp knitting machine including a plurality of vertically reciprocated needles with one or more yarn guides supported for clockwise and counterclockwise reciprocal movement above the needles to direct yarns thereto in the formation of the tubular fabric and wherein improved drive means is provided for imparting the clockwise and counterclockwise reciprocal movements to the yarn guide.

BACKGROUND OF THE INVENTION

It is generally known to knit a circular warp knit tubular fabric on a circular warp knitting machine by feeding yarns to vertically reciprocated needles through yarn guides supported for clockwise and counterclockwise reciprocal movement above the needles In most machines of this type, the reciprocal movement is imparted to the yarn guides by a rack and pinion type of drive. This type of rack and pinion drive is noisy, particularly when operated at high speeds, and the speed at which this type of drive can be operated is limited. This type of rack and pinion drive arrangement is subject to rapid wear since the teeth of the rack and pinion undergo severe stress when the rack and pinion reverse directions at each end of the shogging movements imparted to the yarn guides.

U.S. Pat. No. 3,939,671 discloses a circular warp knitting machine for knitting cord-like tubular fabric and the yarn is fed to vertically reciprocated needles by guide arms which are provided with yarn feed guides in one end with the opposite end being drivingly attached to rotating disks so that the yarn feed ends of the guide arms are moved in orbital paths of travel around and above the vertically reciprocated needles. The drive disks are continuously rotated by means of timing belts and timing belt pulleys. However, the orbital path of travel of the yarn feed ends of the guide arms require a great deal of space in the area above the vertically reciprocated needles so that it is not practical to feed a large number of body or ground yarns to the needles, or to also feed inlay yarns to the vertically reciprocated needles in this type of circular warp knitting machine. The movement of the yarn feed ends of the guide arms in an orbital path of travel also tends to limit the speed at which the machine may be operated.

SUMMARY OF THE INVENTION

With the foregoing in mind, it is an object of the present invention to provide a circular warp knitting machine with an improved drive means for imparting clockwise and counterclockwise reciprocal movements to the yarn guides which permits a plurality of body or ground yarns to be fed to the vertically reciprocated needles and to also permit the feeding of a plurality of essentially vertically inclined and unencumbered inlay yarns so that the knitting machine can be operated at a high sped and the noise level is substantially reduced.

The improved drive means of the present invention is particularly adapted for use in a circular knitting machine including a plurality of vertically reciprocated needles and a base yarn guide sleeve supported for clockwise and counterclockwise reciprocal movement above the needles to direct base or ground yarns to the needles in forming tubular fabric thereof. The improved drive means includes an endless tensioned timing belt drivingly connected to the yarn guide sleeve. A crack arm is drivingly connected at one end to the endless timing belt and a rotary drive wheel is connected to the opposite end of the crank arm for imparting continuous longitudinal reciprocation to the crank arm and to thereby impart reciprocating movement to the endless timing belt and to the base yarn guide sleeve drivingly connected to the endless timing belt. A first timing belt pulley is drivingly connected to the base yarn guide sleeve and a second timing belt pulley is spaced from the first timing belt pulley with the timing belt being entrained around the first and second timing belt pulleys. One end of the crank arm is drivingly connected to one of the runs of the timing belt to thereby impast clockwise and counterclockwise reciprocal movement to the base yarn guide sleeve. A slide plate is supported adjacent one of the runs of the timing belt and a slide block is drivingly connected to the crank arm and to the one run of the timing belt with the slide block being supported for horizontal sliding movement on the slide plate.

An inlay yarn guide disk may also be provided for directing inlay yarns to the vertically reciprocated needles. The inlay yarn guide disk is also moved in clockwise and counterclockwise reciprocal movements by an additional endless timing belt and an additional crank arm drivingly connected to the additional endless timing belt. In both the drive for the base yarn guide sleeve and for the inlay yarn guide disk, the crank arm drive slows down the shogging speed at opposite ends of the clockwise and counterclockwise reciprocal movements to reduce the stress imparted to the teeth of the timing belt and timing belt pulley so that wear is reduced and increased operating speed of the knitting machine is possible. Also, the timing belt drive cushions the reversal of the direction of movement of the shogging motion imparted to the base yarn guide sleeve and the inlay yarn guide disk.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENT

Figure 1:
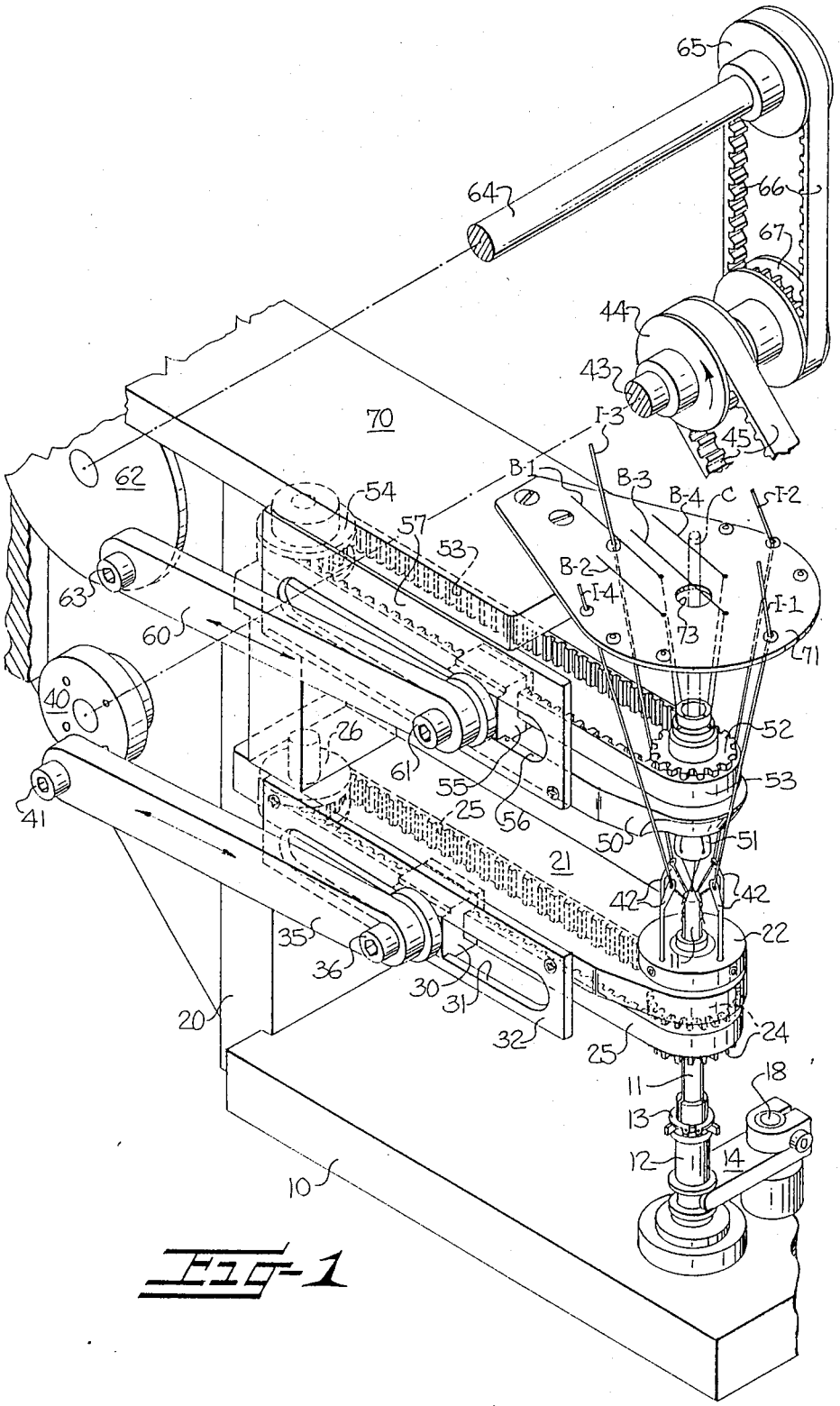
FIG. 1 is a fragmentary isometric view of a portion of a circular warp knitting machine and illustrating the improved drive means of the present invention associated therewith.

The circular warp knitting machine shown in FIG. 1 is of the type disclosed in my copending application Ser. No. 07/182,497, filed Apr. 18, 1988, now U.S. Pat. No. 4,838,043, and includes a base frame member or plate 10 in the forward end portion of which is supported the lower end portion of a hollow and fixed needle cylinder 11. Four latch needles N, only two of which are shown, are circularly arranged and circumferentially spaced apart in longitudinal grooves or slots in the needle cylinder 11 for simultaneous longitudinal up and down movement by means of a vertically reciprocated sleeve 12 surrounding the lower end portion of the needle cylinder 11. The lower butt portions of the needles N are removably connected to the vertically reciprocating sleeve, by means of a snap lock ring 13.

The sleeve 12 is vertically reciprocated or successively raised and lowered by a yoke on one end of a horizontal arm 14, the other end of which is fixedly connected to the upper end of a vertically movable thrust rod 18. The lower end of the vertically movable thrust rod 18 is continuously raised and lowered by a reciprocating mechanism, not shown, rotated by the drive motor of the knitting machine, not shown. A vertical frame member or plate 20 is fixed at its lower end and to the rear end of the lower horizontal frame member 10 and extends upwardly therefrom. The rear end portion of a horizontal support plate 21 is fixed to the rear support frame member 20 and extends forwardly therefrom.

The forward end of the support plate 21 supports an inlay yarn guide disk 22 for clockwise and counterclockwise reciprocal movement around the upper end portion of the needle cylinder 11. The inlay yarn guide disk 22 is drivingly connected to a timing belt pulley 24 supported beneath the forward end of the support plate 21. The forward end of an endless timing belt 25 is entrained and passes around and is drivingly connected to the timing belt pulley 24. The rear end portion of the timing belt 25 passes around an idler timing belt pulley 26 supported for reciprocation on the rear and lower portion of the support plate 21.

Alternating clockwise and counterclockwise reciprocations are imparted to the inlay yarn guide disk 22 by back-and-forth reciprocation of one leg or run of the timing belt 25. The timing belt 25 is moved back and forth by means of a slide block 30 fixed thereto and supported for back-and-forth sliding movement in a guide slot 31 of a guide plate 32. The guide plate 32 is fixed on one side of and extends below the support plate 21 so that the guide slot 31 extends parallel to the horizontally extending portion of one run of the timing belt 25. The forward end of a crank arm 35 is fixed to the guide block 30 by means of a pivot screw 36 and the rear end of the crank arm 35 is connected to a rotating drive wheel 40 by means of a pivot screw 41. The pivot screw 41 is connected to the drive wheel 40 in eccentric relationship to the rotational axis thereof.

The drive wheel 40 is continuously rotated in a counterclockwise direction by means of a drive shaft 43 which has a drive pulley 44 fixed thereto. Continuous rotation is imparted to the pulley 44 by means of a drive belt 45, driven from the knitting machine drive means, not shown. The inlay yarn guide disk 22 is provided with upstanding yarn guides 42 which are spaced in 90-degree relationship with each other and which are utilized for guiding respective inlay yarns I-1 through I-4 to the needles N of the knitting machine, in a manner to be presently described.

The rear end portion of a plate frame member 50 is fixed to the rear frame plate member 20 and extends forwardly therefrom with the forward end supporting the upper end portion of a base or ground yarn guide sleeve 51 for clockwise and counterclockwise reciprocal movement. The base yarn guide sleeve 51 extends upwardly through the plate frame member 50 and has a timing belt pulley 52 drivingly connected thereto. The forward end of a timing belt 53 passes around and is drivingly connected to the timing belt pulley 52 and its rear end is supported on an idler timing belt pulley 54. Reciprocation is imparted to the timing belt 53 by means of a guide block 55. The guide block 55 is connected to one leg or run of the timing belt 53 and is guided for back-and-forth movement in a horizontal slot 56, formed in a guide plate 57, which is suitably supported along its lower edge portion on the frame member 50. The slot 56 extends horizontally and parallel to one run of the timing belt 53. The guide block 55 is drivingly connected to the forward end of a crank arm 60 by means of a pivot screw 61. The rear end of the crank arm 60 is eccentrically connected to a drive wheel 62 by means of a pivot screw 63.

The drive wheel 62 is fixed on one end of a drive shaft 64. The other end of the drive shaft 64 has a timing belt drive pulley 65 fixed thereto. Continual counterclockwise rotation is imparted to the drive wheel 62 by means of a timing belt 66 drivingly engaging the timing belt drive pulley 65 and a timing belt drive pulley 67, fixed on the drive shaft 43. Thus, the crank arm 60 is moved back and forth, along with opposite runs of the timing belt 53, to impart successive clockwise and counterclockwise reciprocations to the timing belt pulley 52 and the base yarn guide sleeve 51.

The rear end portion of an upper frame plate member 70 is fixed on the upper end of the rear plate frame member 20 and extends forwardly therefrom. A yarn guide plate 71 is fixed on the forward end of the frame member 70 and extends forwardly thereof and is spaced above the timing belt pulley 53. An outer circular arrangement of spaced-apart yarn guide eyes is provided in the yarn guide plate 71 for directing the respective inlay yarns I-1 through I-4 downwardly and into the guide eyes on the upper ends of the inlay yarn guides 42. The inlay yarn I-3 extends downwardly from the guide plate 71 and through a slot, not shown, extending through the frame member 50.

An inner circle of yarn guide openings is provided in the yarn guide plate 71 for reception of respective base or ground yarns B-1 through B-4 and for directing the same downwardly and through vertical passageways and along the outer surface of the base yarn guide sleeve 51 to pass through yarn guide openings therein and to the needles N. A central yarn guide opening 73 is provided in the yarn guide plate 70 so that a core yarn, indicated in dash-dot lines at C in FIG. 3, can be directed therethrough and downwardly through the hollow center of the sleeve supporting the upper timing belt pulley 52 for reciprocation thereon. When the core C is incorporated in the circular warp knit composite cord, the core C also extends downwardly through the center of the needle cylinder 11 and the machine is provided with a suitable take-up mechanism, not shown, for withdrawing the circular warp knit composite cord as it is knit. The take-up mechanism also applies the desired amount of tension on the circular warp knit composite cord.

The timing belt drive arrangement for reciprocating the base yarn guide sleeve 51 and the inlay yarn guides 42 permits faster operating speeds for the knitting machine than have heretofore been possible. The driving of the timing belts 25, 53 by the corresponding crank arms 35, 60 also contributes to the increased operating speed of the circular warp knitting machine because the corresponding drive wheels 40, 62 impart the higher speed of movement to the timing belts 25, 53 during the medial portion of their reciprocating strokes and slow the movement of the timing belts 25, 53 as they approach the end portions of the stroke when they reverse directions. Thus, the teeth of the timing belts and the teeth of the timing belt pulleys are not subjected to the severe stress which is imparted to a drive mechanism of the type utilizing a rack and pinion and the back-and-forth reciprocation is "cushioned" in accordance with the present invention. The timing belt drive arrangement also reduces the noise generated by the usual rack and pinion drive arrangements. For example, the present circular warp knitting machine illustrated in the drawings has been operated at speeds of approximately 4,000 courses per minute while conventional circular warp knitting machines are commonly operated in the range of 800 to 1,200 courses per minute.

Method of Knitting

Figure 2:
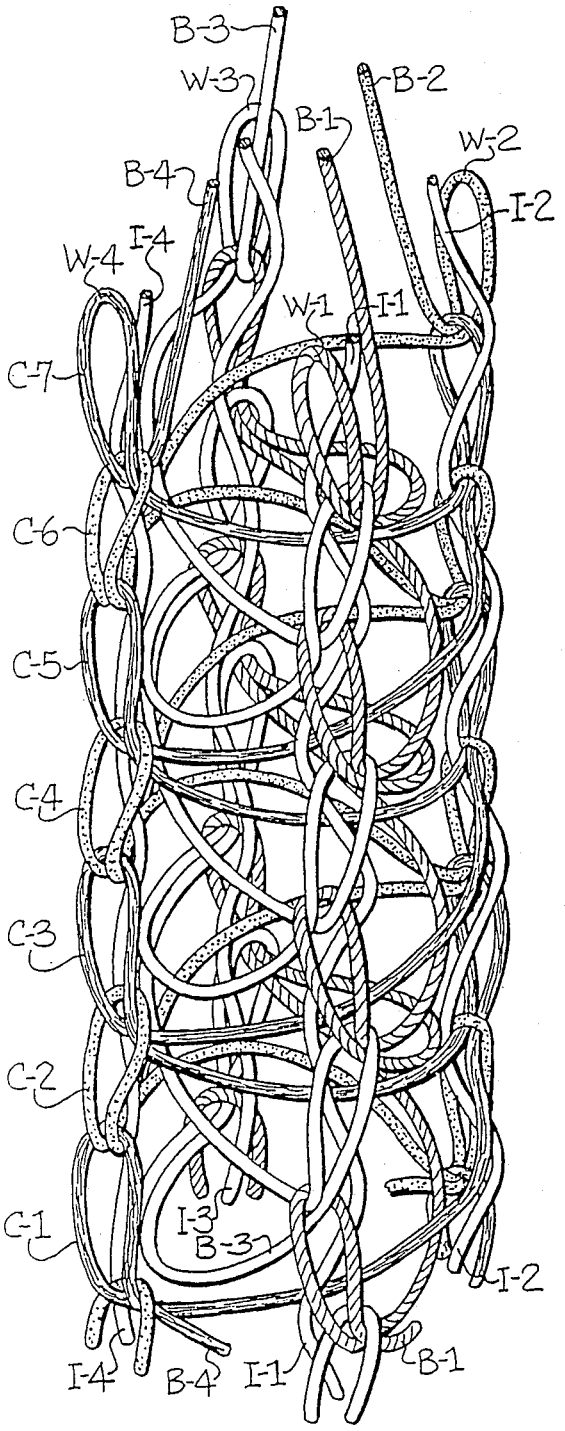
FIG. 2 is a greatly enlarged and somewhat schematic view showing the loop structure of one type of circular knit composite cord which may be knit with the circular warp knitting machine.
Figure 3:
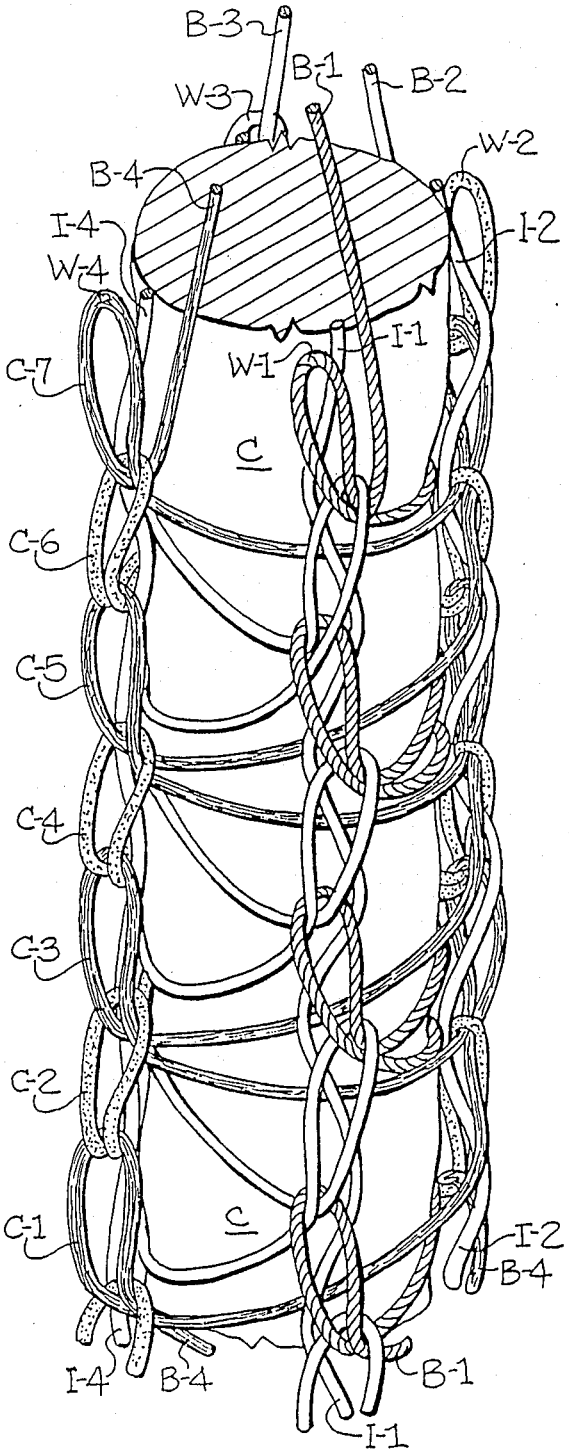
FIG. 3 is a view similar to FIG. 1 but further illustrating a core element extending along the central portion of the composite cord.

The method of knitting the circular warp knit composite cord of FIGS. 2 and 3 has been described in detail in my aforesaid copending Application Serial No. 07/182,497, now U.S. Pat. No. 4,838,045 filed Apr. 18, 1988, to which reference may be made. Therefore, only a brief description of the method of knitting will be described in the present application. Assuming that the needle loops have just been formed in the wales W-1 through W-4 of course C-1 (FIG. 2) of the corresponding base or ground yarns B-1 through B-4, the base yarn guide sleeve 51 reciprocates in a counterclockwise direction to feed the corresponding body yarns B-1 through B-4 to diametrically opposed needles and to form the stitch loops, as indicated in course C-2. At the same time, the inlay yarn guides are moved to position the inlay yarns I-1 through I-4 on opposite sides of the corresponding needles. During the knitting of the course C-3, the base yarn guide sleeve 51 reciprocates in a clockwise direction so that the corresponding yarns B-1 through B-4 are fed to and form stitch loops on diametrically opposed needles. This back-and-forth shogging movement of the base yarn guide sleeve 51 continues, along with the slight reciprocation of the inlay yarn guides 42 during the knitting of the remaining courses C-4 through C-7, as illustrated in FIG. 2.

The tubular fabric illustrated in FIG. 3 is knit in the same manner as the tubular fabric of FIG. 2 except that the core yarn C is fed downwardly through the opening 73 in the guide plate 71, and through the center of the needle cylinder 11 so that the tubular fabric is knit therearound, as illustrated in FIG. 3.

The method of knitting described and illustrated in FIGS. 2 and 3 may be termed alternate wale knitting in which the base yarn guide sleeve 51 is reciprocated slightly over 180° each time that the needles are raised so that stitch loops are formed on opposite sides of the warp knit tube in successive courses. However, it is to be understood that needle loops in successive courses could be formed on adjacent needles and the base yarn guide sleeve 51 would then be reciprocated slightly over 90° in opposite directions. Also, a flat strip of fabric could be knit by eliminating one of the needles in the needle cylinder and a corresponding base or ground yarn, along with the corresponding inlay yarn, so that a flat circular warp knit fabric is produced.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a circular warp knitting machine including a plurality of vertically reciprocated needles, and yarn guide means supported for clockwise and counterclockwise reciprocal movement above said needles to direct yarns to said needles, the combination therewith of improved drive means for imparting clockwise and counterclockwise reciprocal movements to said yarn guide means, said improved drive means comprising (a) endless belt means drivingly connected to said yarn guide means, (b) crank arm means drivingly connected at one end to said endless belt means, and (c) rotary drive means connected to the opposite end of said crank arm means for imparting continuous longitudinal reciprocation to said crank arm means and to thereby impart reciprocating movement to said endless belt means and to said yarn guide means drivingly connected to said endless belt means.

2. In a circular warp knitting machine according to claim 1 wherein said endless belt means comprises a first timing belt pulley drivingly connected to said yarn guide means, a timing belt entrained around said first timing belt pulley, and a second timing belt pulley spaced from said first timing belt pulley and around which said timing belt is entrained.

3. In a circular warp knitting machine according to claim 2 wherein said first and second timing belt pulleys are each supported for clockwise and counterclockwise reciprocal movement about a vertical axis, wherein said timing belt includes first and second runs extending horizontally between said first and second timing belt pulleys, and wherein said one end of said crank arm means is drivingly connected to one of said runs of said timing belt.

4. In a circular warp knitting machine according to claim 3 including slide plate means supported adjacent one of said runs of said timing belt, and slide block means drivingly connected to said one end of said crank arm means and to said one run of said timing belt, said slide block means being supported for horizontal sliding movement on said slide plate means.

5. In a circular warp knitting machine according to claim 1 wherein said yarn guide means includes a base yarn guide sleeve for directing base yarns to said vertically reciprocated needles, and an inlay yarn guide disk including yarn guides for directing inlay yarns to said vertically reciprocated needles, and wherein said improved drive means for imparting clockwise and counterclockwise reciprocal movements to said yarn guide means includes first endless belt means drivingly connected to said inlay yarn guide disk, first crank arm means drivingly connected at one end to said first endless belt means, first rotary drive means connected to the opposite end of said first crank arm means for imparting continuous longitudinal reciprocation to said first crank arm means and to thereby impart reciprocating movement to said first endless belt means and to said inlay yarn guide disk, second endless belt drive means drivingly connected to said base yarn guide sleeve, second crank arm means drivingly connected at one end to said second endless belt means, and second rotary drive means connected to the opposite end of said second crank arm means for imparting continuous longitudinal reciprocation to said second crank arm means and to thereby impart reciprocating movement to said second endless belt means and to said yarn guide disk drivingly connected to said second endless belt means.

* * * * *